United States Patent [19]

Belaidouni et al.

[11] Patent Number: 4,856,183

[45] Date of Patent: Aug. 15, 1989

[54] DEVICE FOR FITTING AND CRIMPING END PIECES ON ELECTRIC CONDUCTORS

[75] Inventors: Ali Belaidouni, Dijon; André Benani, Seurre; Jean-Marie Millet, Bellefond, all of France

[73] Assignee: La Telemecanique Electrique, France

[21] Appl. No.: 190,989

[22] Filed: May 6, 1988

[30] Foreign Application Priority Data

May 6, 1987 [FR] France ..... 87 06366

[51] Int. Cl.[4] ..... H01R 43/04

[52] U.S. Cl. ..... 29/753; 29/564.1; 29/565; 29/715; 29/761

[58] Field of Search ..... 29/753, 761, 564.1, 29/564.4, 565, 715

[56] References Cited

U.S. PATENT DOCUMENTS 4,720,912 1/1988 Frohlich ..... 29/753

*Primary Examiner*—Carl E. Hall

*Attorney, Agent, or Firm*—William A. Drucker

[57] ABSTRACT

A device for fitting and crimping end pieces on electric conductors includes an end-piece distributor, a holding device for maintaining the end of the conductors in position and a device for transferring the end-pieces from the distributor to the holding device and for positioning the end pieces on the ends of the conductors at the end of such transfer. The transfer device includes a crimping device as well as a closure means, partially closed at rest, which may pass to the open condition under the action of stop devices provided respectively close to the distributor and the holding means so as to make possible access to and/or removal of the end piece.

9 Claims, 6 Drawing Sheets

DEVICE FOR FITTING AND CRIMPING END PIECES ON ELECTRIC CONDUCTORS

BACKGROUND OF THE INVENTION

1. Field of the Invention

The present invention relates to a device for fitting and crimping connection end-pieces on the stripped ends of electric conductors.

It is known that this type of end-piece is frequently used for facilitating the connection of flexible multi-strand electric conductors covered with an insulating sheath to clamping terminals.

2. Description of the Prior Art

It is usually formed, for example as described in the patent FR No. 1 468 859 in the name of the applicant, of a tubular metal element intended to receive the stripped end of the conductor, and an insulating sleeve which extends the tubular element on one side and in which the end of the insulating sheath is engaged.

Of course, this end-piece may be fitted manually using traditional tools. However, this method, which is too costly in time and labor, is not suitable for industrial high rate wiring productions.

This is why machines have already been proposed for automatically fitting these end-pieces, comprising more particularly:

an end-piece supply device;

means for guiding the end of the conductor which it is desired to equip and holding it in position;

a device for stripping this end;

a device for fitting the end-piece on the stripped end of the conductor; and a device for crimping the end piece once it is positioned on said end.

Considering the fact that in most of these machines the distribution station and the station for receiving and holding the end of the conductor in position and fixed and are situated at different positions, it is necessary to provide a transfer device for receiving the end-pieces delivered by the distributor and then transporting them as far as said reception and holding station where the end-piece is generally fitted and crimped. Usually, this transfer device includes a crimping device associated with an end-piece reception means as well as possibly a stripping device.

The invention provides more particularly a device of said type for fitting and crimping end-pieces, in which access by the transfer device to said distribution and holding stations takes place following relative translational movements between said stations and said transfer device, during which translational movements the end-piece reception means is held in position coaxially with the station to which it accedes.

SUMMARY OF THE INVENTION

Its purpose is more particularly:

to allow interchangeable end-piece reception means to be used appropriate to different end-piece sizes and shapes, to provide self centering of the end-piece delivered by the distribution device when it is inserted into the end-piece reception means, to ensure better positioning of the end-piece inside the reception means and to hold it in position during transfer, so as to be able to obtain accurate centering of this end-piece with respect to the end-piece fitting and crimping station, to provide self alignment of the stripped end of the conductor during the fitting of the end-piece.

To obtain these results, the invention provides an end-piece fitting and crimping device of the type described above comprising at least:

an end-piece supply device;

a device for guiding and holding in position the end of the conductor it is desired to equip, a transfer device adapted for receiving in a reception means the end-pieces delivered by the distributor and then transporting them to the guide and holding device, and at the end of travel positioning the end-piece on the end of the conductor; and a device for crimping the end piece once positioned on said end, access of the transfer device to the supply device and to the guide and holding device taking place following translational movements during which the reception means is held coaxial to the device to which it accedes.

In accordance with the invention, this device is more particularly characterized in that the transfer device further includes a closure device having at least two jaws movable above the reception means, so as to be able to occupy two positions, namely: a closed position in which the jaws define a through passage therebetween whose minium section is at least equal to the section of the stripped conductor, but is however less than the maximum section of the end-piece, and an open position in which the minimum section of the pasage defined by the jaws is at least equal to the maximum section of the cavity of the reception means, and in that the distribution and reception devices each include a stop device adapted for cooperating with at least one cam surface provided on the closure device for causing the jaws to pass from the open position to the closed position when the transfer device accedes to one or other of these two devices.

Advantageously, the through passage defined by the two jaws of the closure device has a widening shape, preferably conical, opening on the side opposite the end-piece reception means.

It follows from the above described structure that when the transfer device is in the distribution station, the jaws of the closure device are in the open position because of the action of said stop device on said cam surface. The cavity of the end-piece reception means is therefore free for access and may then receive an end-piece coming from the distribution device. The widening form of the passage defined by the jaws then provides self-centering of the end-piece when it is introduced into the reception means. Once it is introduced, the transfer device begins its movement which will take it as far as the end-piece fitting station. In the first part of this travel which consists of a translational movement along the axis of the distribution device, the cam surface escapes from the action of the stop device, so that the jaws of the closure device return to the closed position. In this position, the end-piece is held in the cavity of the reception means by the jaws.

At the end of this movement, the transfer device comes in line with the reception and holding station by effecting a translational movement. During this movement, the stripped end of the conductor which, theoretically, extends coaxially to the reception means, is engaged in the end-piece through the pasage defined by the jaws which have remained closed. Hereagain, the widening shape of this pasage may play a self centering role for the stripped end of the conductor, should this latter not be suitably centered. At the end of travel, the action on said cam surface of the stop device provided in the reception and holding station will cause the closure device to pass to the opening position. In this position, the stripped end of the conductor is completely engaged in the end-piece and this latter may then be crimped. Once this latter operation has been carried out, the transfer device may begin its return travel to the distribution station. The end-piece which is crimped on the end of the conductor is then extracted in the first part of this return travel before the closure device returns to the closed position.

As mentioned above, the end-piece reception member is removably mounted in the transfer device so as to be able to use a range of reception members appropriate for different types of end-pieces, and, in particular, for end-pieces, each corresponding to conductors having different diameters.

It should however be noted that fitting of end-pieces to conductors of different diameters can only be achieved with a reception and holding station appropriate for receiving conductors of different diameters.

The invention provides then a solution for solving this problem in a particularly advantageous way, which solution consists in using, for centering and holding the conductor in position, two jaws movable in opposite directions with respect to each other along the same axis of translation, under the effect of an actuating device such for example as a jack. These two jaws then have two cooperating bits of complementary shape each having, on each side of a first plane parallel to the axis of translation, two respective faces oblique with respect to each other and extending in two secant planes perpendicular to said first plane and the straight line of intersection of which divides each of said faces into two portions preferably, but not necessarily, offset with respect to each other.

As will be discussed in the rest of the description, besides the fact that such a conformation makes it possible to use conductors having different diameters, it provides better guidance of these conductors, while eliminating the risks of twisting at the time of clamping the jaws.

BRIEF DESCRIPTION OF THE DRAWINGS

Several embodiments of the invention will be described hereafter by way of non limitative examples, with reference to the accompanying drawings in which.

Figure 3:
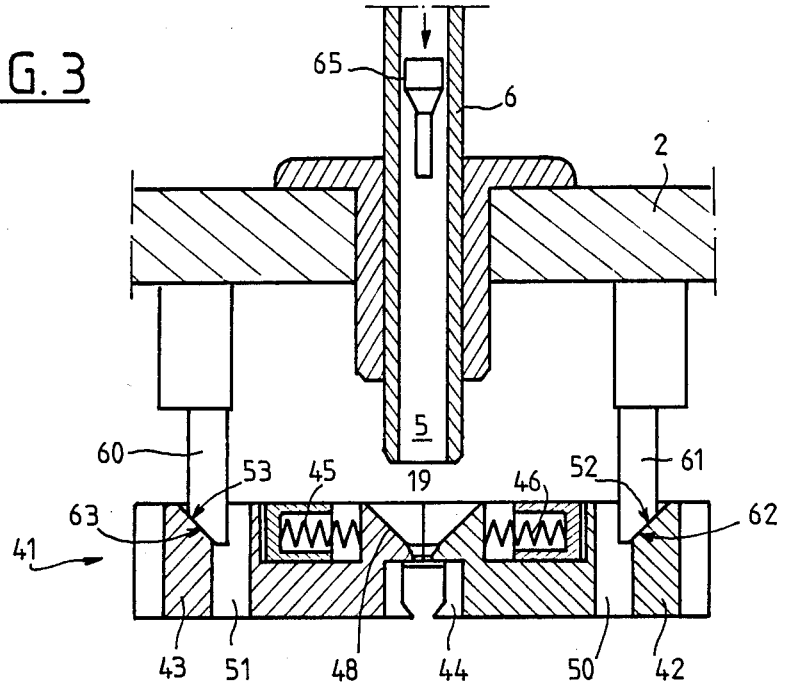
FIGS. 3 to 7 are partial schematical sections for illustrating the operating principle of the closure device shown in FIG. 2.
Figure 4:
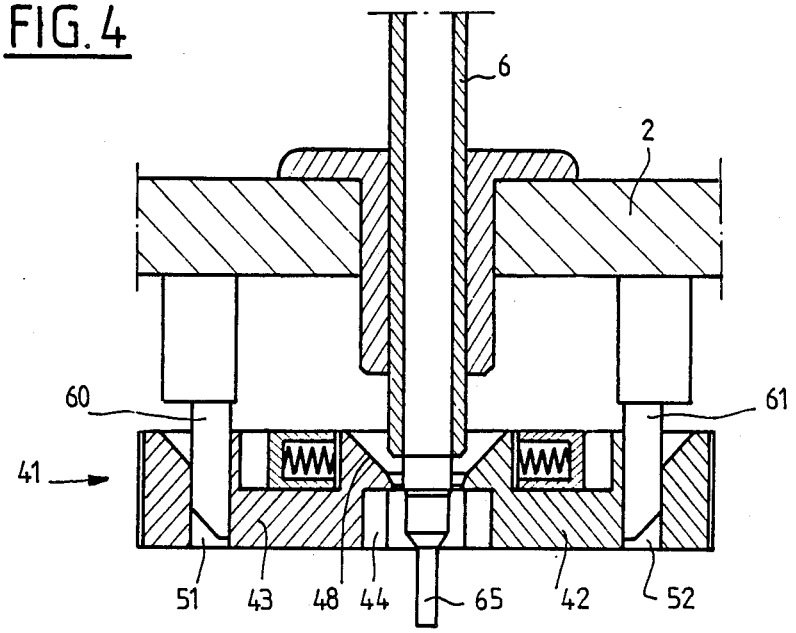
Figure 5:
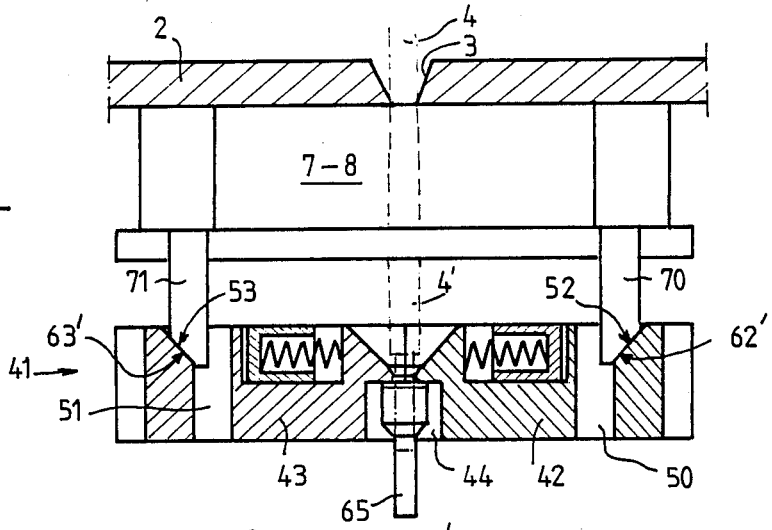
Figure 6:
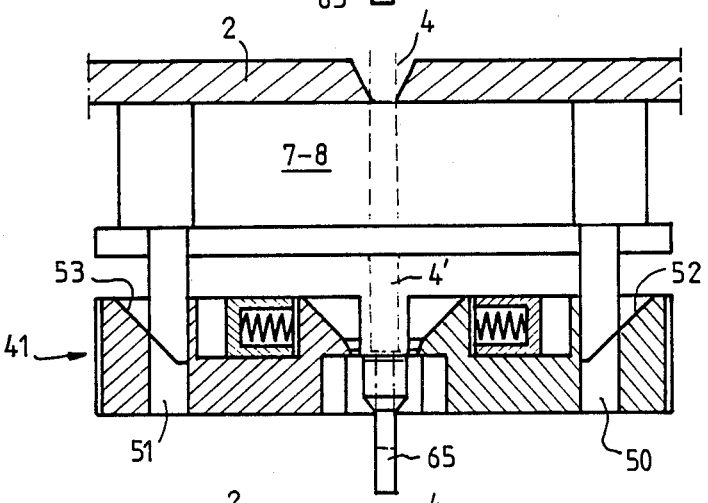
Figure 8:
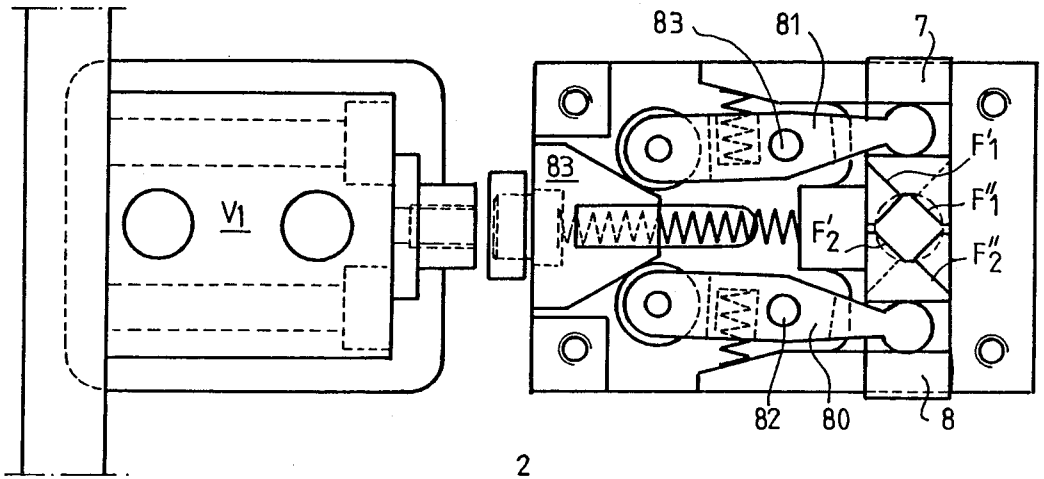
Figure 9:
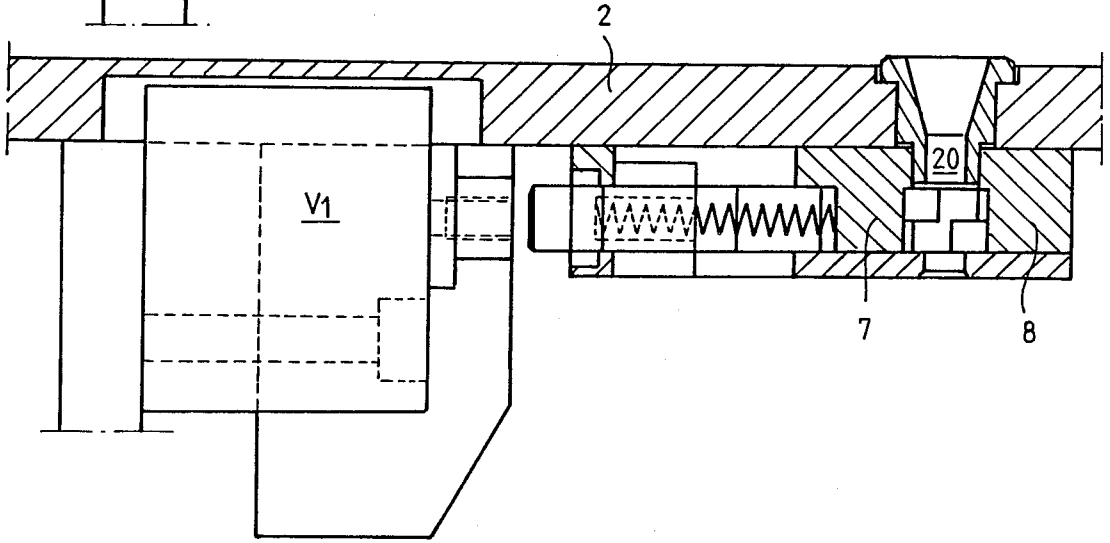
Figure 10:
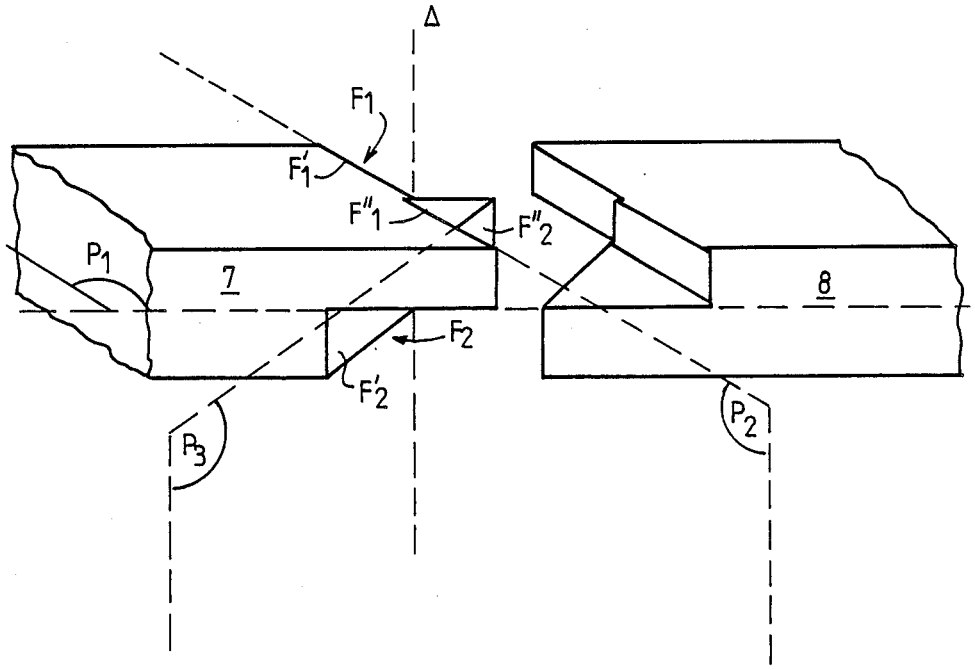

during the phase for distributing and receiving an end-piece (FIGS. 2 and 3), during the phase for fitting and crimping this end-piece on the stripped end of a conductor (FIGS. 4, 5 and 6);

FIGS. 8 and 9 show in a top view (FIG. 8) and in a side veiw (FIG. 9) a device for guiding and holding the conductor in accordance with the invention; and FIG. 10 is a schematical perspective view for showing the shape of the jaws used in the guide and holding device in the position shown in FIGS. 8 and 9.

DESCRIPTION OF THE PREFERRED EMBODIMENTS

Figure 1:
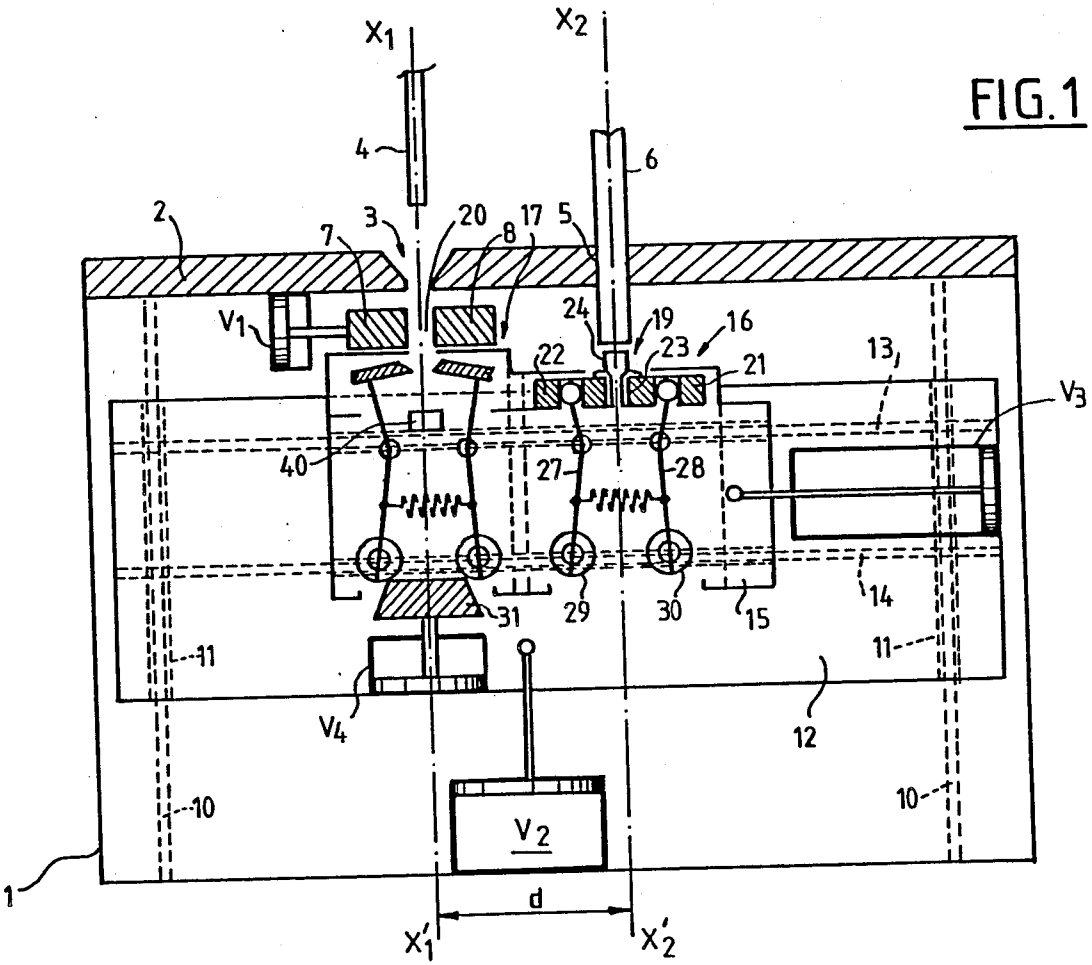
FIG. 1 is a schematical representation illustrating the principle of a machine for the automatic fitting of end-pieces which may receive the end-piece fitting and crimping device of the invention.

Such as shown in FIG. 1, the machine comprises first of all a fixed structure 1 (shown schematically by a rectangle), having a plate 2 with an orifice 3 for inserting the end of conductor 4 which it is desired to strip and an orifice 5 through which passes a tubular element 6 for distributing the end-pieces. The axes $X_1$, $X'_1$, $X_2$, $X'_2$ of orifice 3 and of element 6 are parallel and situated at a distance d from each other. These two axes are preferably vertical.

The introduction orifice 3 is further equipped with a device for holding the end of conductor 4 in a rectilinear position, including two jaws or bits 7, 8 one at least of which is actuated by a cylinder $V_1$ fixed to the fixed structure 1.

On this fixed structure 1 is slidably mounted, by means of slides 10 shown schematically with broken lines, a structure 12 movable in translation parallel to the axes $X_1$, $X'_1$, $X_2$, $X'_2$ under the action of a cylinder $V_2$ carried by the fixed structure 1.

This mobile structure 12 itself includes means 13, 14 for guiding a carriage 15 movable perpendicular to the axes $X_1$, $X_2$ and whose movements are controlled by a cylinder $V_3$ fixed to said structure 12.

This carriage 15 supports the device 16 for receiving and crimping the end-pieces delivered by the tubular distribution element 6 as well as a stripping device 17, these two devices having access orifices 19, 20, directed parallel to one another and to the axes $X_1$, $X'_1$, $X_2$, $X'_2$ and spaced apart by a distance equal to distance d. These two orifices 19, 20 are disposed on the side of carriage 15 facing plate 2.

More precisely, the end-piece reception and crimping device 16 is formed of at least two clamping jaws 21, 22 defining therebetween, in the rest position, a cavity 23 of a shape substantially complementary to that of an end-piece crimped in the desired shape. These two jaws 21, 22 may be actuated for crimping the end-piece by a cylinder $V_4$ fixed to the mobile structure through an appropriate lever and cam transmission system 27, 28, 29, 30, 31.

It follows from the above description that, depending on the position of cylinders $V_2$ and $V_3$, carriage 15 may occupy four fixed positions with respect to the fixed structure 1, namely:

a first position in which it is at the top and at the right;

a second position in which it is at the bottom and at the right;

a third position in which it is at the bottom and at the left a fourth position in which it is at the top and at the left.

In its first position, carriage 15 is placed so that the orifices 19, 20 for access to the reception 16 and stripping 17 devices are respectively coaxial with the distribution orifice of the tubular element 6 and with the orifice 3 for introducing conductor 4.

Thus, in a first operating phase, the end of conductor 4 is inserted in the stripping device 17 by causing it ot pass through the introduction orifice 3 until its end comes to bear on a stop element 40 which may be adjustable and which defines the length of the section to be stripped.

During the next phase, cylinder $V_1$ is activated to cause jaws 7, 8 to clamp and, consequently, to hold conductor 4 in position upstream of the portion to be stripped. Concurrently, the stripping device is activated so as to shear the insulating sheath of the conductor.

Removal of the insulating sheath covering the portion of the conductor to be stripped is then caused by activating cylinder $V_2$ so as to move the mobile structure 12 and, consequently carriage 15, in a downwards translational movement, parallel to axes $X_1$, $X_2$.

Once this removal has been carried out, the stripping device is deactivated. Cylinder $V_3$ is then activated and causes carriage 15 to move leftwards, until it reaches its third position.

In this position, the extremity of end-piece 24 engaged in cavity 23 defined by jaws 21, 22 is substantially coaxial to the end of the previously stripped conductor 4.

Activation of cylinder $V_2$ so as to cause an upward movement of the structure 12/carriage 15 assembly then causes end-piece 24 to be engaged on the stripped part of conductor 4, whereas the sheath portion previously removed is discharged. The crimping device is then activated.

Once the crimping operation is finished, cylinder $V_2$ is activated for moving the mobile structure 12/carriage 15 assembly downwards, at the end of which movement the carriage comes back to its third position.

The carriage is then brought to its second position then to its first position following the successive activation of cylinders $V_3$ and $V_2$.

Once the carriage has reached its first position, a new conductor may be introduced into the stripping device, whereas a new end-piece coming from the tubular element 6 may be engaged in the recess 23 defined by jaws 21, 22.

A new operating cycle may then begin.

It should be noted that the invention is not limited to the kinematic principle of the above described machine: it forms in fact only one embodiment compatible with the principle of the device of the invention.

As mentioned above, the device of the invention comprises in a structure, such for example as the one described above, a closure device associated with the end-piece reception and crimping device.

Figure 2:
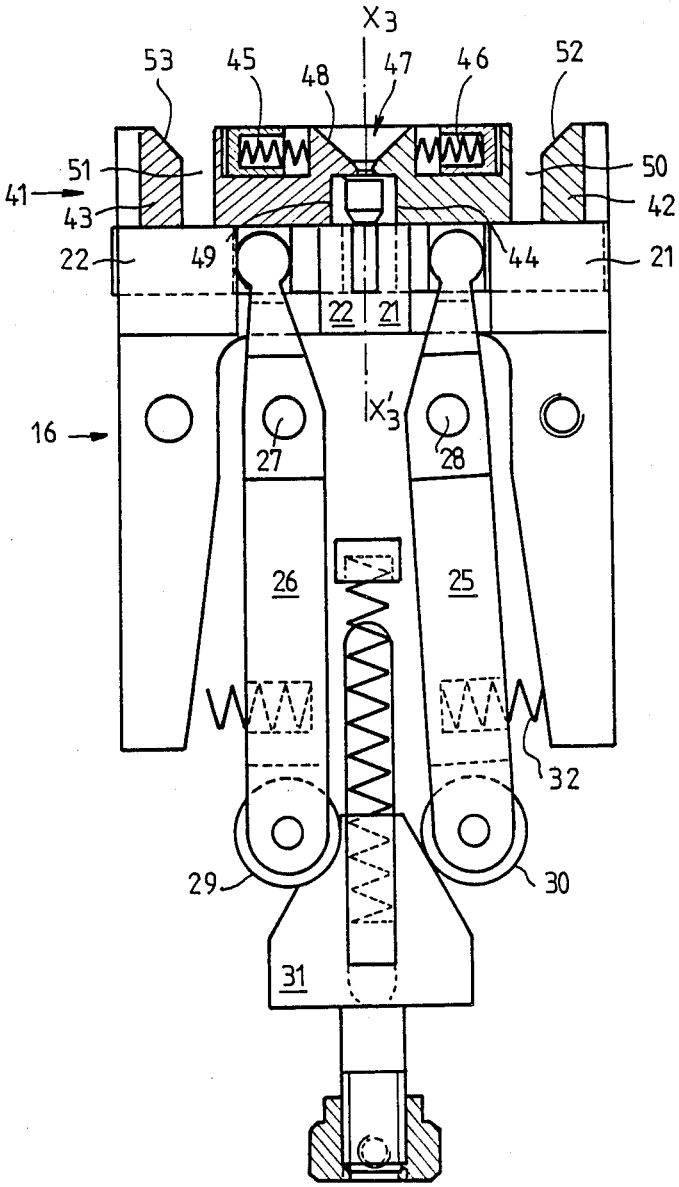
FIG. 2 is an axial section of a reception and crimping device of the type used in the machine shown in FIG. 1, but equipped with a closure device of the invention.

By way of example, FIG. 2 shows partially on a larger scale, an end-piece reception and crimping device 16 of the type used in the machine shown in FIG. 1, equipped with such a closure device 41.

This closure device 41 is formed of two jaws 42, 43 movable with respect to each other in a plane perpendicular to the axis $X_3$, $X'_3$ of the end-piece reception means 44, just above the jaw bits 21, 22, of the crimping device 16.

These jaws 42, 43 are pushed towards each other by return springs 45, 46 so as to occupy a rest position in which they define a through passage 47 coaxial with the reception means 44 and whose smallest cross section is substantially equal to the external diameter of the stripped conductor 4 on which it is desired to fit an end-piece. Advantageously, jaws 42, 43 are formed so that this passage has a conical shape 48 opening on the side opposite the end-piece reception means 44 so as to play a self centering role for the end-pieces when they are introduced into said means.

In this example, the end-piece reception means 44 which only serve for receiving the head of the end-pieces projects above the crimping device 16. These jaws 42, 43 then comprise, below said conical shape 48, a cavity 49 of a shape substantially complementary to that of the external side surface of the end-piece reception means 44.

Furthermore, jaws 42, 43 comprise for their actuation two respective bores 50, 51 directed parallel to the axis of the reception means 44, these two bores 50, 51 each having an oblique cam surface 52, 63 intended to cooperate with stop devices fixed to the fixed structure of the machine and shown in FIGS. 3 to 7.

It should be noted first of all that, in these Figs., only the closure device and the essential parts of the fixed structure with which it cooperates have been shown.

Thus, in FIGS. 3 and 4, which correspond to the arrival of the carriage into its first position, only the part of the fixed structure 1 carrying the tubular element for distributing the end pieces 6 is indicated, since the other parts of the machine may consist of those shown in FIG. 1

As can be seen FIGS. 3 and 4, plate 2 of the fixed structure 1 of the machine comprises, on each side of the tubular element 6, two rods 60, 61 having oblique end faces 62, 63 which extend downwards parallel to the axis of said element 6. These two rods 60, 61 are more particularly positioned so as to be able to penetrate into bores 50, 51 formed in jaws 42, 43 while acting on the cam surfaces 52, 53 when carriage 15 arrives into said first position.

In the position shown in FIG. 3, the oblique surfaces 62, 63 of rods 60, 61 have been shown at the moment when they come into contact with the cam surfaces 52, 53, jaws 42, 43 being still in the rest position.

It is clear that during further movement of carriage 15 towards plate 2, the action of the oblique surfaces 62, 63 on cams 52, 53 will cause jaws 42, 43 to open until at the end of travel rods 60, 61 are totally engaged in bores 50, 51, as shown in FIG. 4.

In this position, the oblique surfaces 62, 63 no longer cooperate with the cam surfaces 52, 53 and therefore lock jaws 42, 43 in the open position.

Because jaws 42, 43 are open, the reception means 44 may receive an end piece 65 delivered by the tubular distribution element 6.

Then, during the return travel of carriage 15, rods 60, 61 are freed from jaws 42, 43 so that they return to a rest position thus holding end-piece 65 captive inside the reception means.

Similarly, plate 2 of the machine includes, on each side of the introduction orifice 3, two rods 70, 71 similar to the above described rods 60, 61, and disposed similarly so as to be able to cooperate with the cam surfaces 52, 53, and bores 50, 51 of the jaws.

Figure 7:
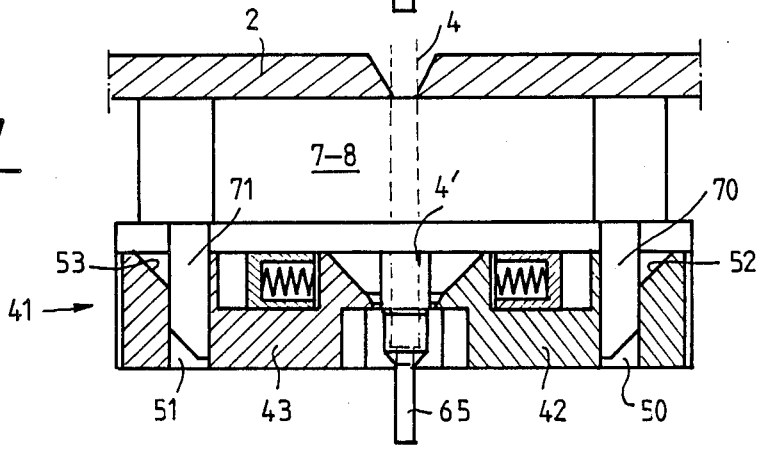

These rods 70, 71 are shown in FIGS. 5 to 7 where there can be seen more particularly the end 4' of a conductor 4 which extends from the guide and holding device 7, 8 (shown schematically by a rectangle).

FIG. 5 shows the closure device 41 at the moment when the oblique faces 62', 62' of rods 70, 71 come to bear on the cam surfaces 52, 53 of the bores of jaws 42, 43. These latter are therefore again in the rest position but nevertheless let the stripped end of conductor 4 pass which may be introduced into the reception means 44.

It should be noted in this connection that the introduction of the stripped end of conductor 4 is facilitated because of the self-centering produced by the conical shape 48 of jaws 42, 43 and because jaws 7, 8 hold the flexible conductor rectilinearly without twisting.

FIG. 6 shows an intermediate phase in which, under the effect of the action of the oblique surfaces 62', 63' of rods 70, 71 on the cam surface 52, 53, the jaws are sufficiently spaced apart to let the insulator of conductor 4 pass. It is clear that in this phase where the stripped end of conductor 4 penetrates into the tubular sleeve of the end piece, it is no longer necessary to guide conductor 4.

In the position shown in FIG. 7 which corresponds to said fifth position, jaws 42, 43 are in the open position and conductor 4 is completely engaged in end-piece 65. The crimping operation may then take place, the end of conductor 4 with its end-piece 65 then being removed during the return travel of carriage 15. After such removal, rods 70, 71 are released from bores 50, 51 and jaws 42, 43 return to the rest position.

FIGS. 8 and 9 show a preferred embodiment of a device for guiding and holding the end of the conductors in position, which may be used in combination with the device of the invention.

This device includes two jaw bits 7, 8 actuated by a cylinder $V_1$ through a transmission device including two levers 80, 81 mounted for pivoting about two respective axes 82, 83, each of these levers 80, 81 including a first end articulated to a corresponding jaw bit 7, 8 and a second end cooperating with a cam 83 actuated by cylinder $V_1$.

In this example, each jaw bit 7, 8 is formed of a trapezoidal piece having at one of its ends an assembly profile shown in perspective in FIG. 10, this profile being intended to cooperate with the corresponding profile of complementary shape on the other jaw bit.

More precisely, each of these assembly profiles has, on each side of a plane $P_1$ parallel to the translational axis, two respective oblique faces $F_1$, $F_2$, which extend in two secant planes $P_2$, $P_3$ perpendicularly to the plane $P_1$, and whose straight line of intersection $\Delta$ divides each of the two faces $F_1$, $F_2$ in two parts offset with respect to each other $F'_1$, $F''_1-F'_2$, $F''_2$. Advantageously, the two planes $P_2$, $P_3$ are perpendicular to each other which means that the clamping forces are distributed evenly over the circumference of the conductor.

The advantage of this solution consists in that on clamping, the conductor is subjected to diametrically opposite forces; since the resultant of these forces is consequently zero, the conductor undergoes no deformation prejudicial to the fitting of the end-piece. Furthermore, this solution makes it possible to use conductors of different sections, over a wide range going from a very small value up to a value substantially of the order of the width of the jaws.

What is claimed is:

1. A device for fitting and crimpng end-pieces on a stripped electric conductor, said device comprising:

i—an end-piece supply device;

ii—a holding device for guiding and holding in position said conductor, iii—a transfer device receiving in a reception means having a cavity the end-pieces delivered by said end-piece supply device and then transporting them to said holding device, said transfer device, at the end of a predetermined travel, positioning an end-piece on the end of the stripped conductor; and iv—a device for crimping the end-piece once positioned on said end, v—access of the transfer device to the supply device and to the holding device taking place following translational movements during which the reception means is held coaxial to the device to which it accedes, wherein the transfer device further includes a closure device having at least two jaws movable above the reception means, so as to occupy a closed position in which the jaws define a through passage therebetween whose minimum section is at least equal to the section of the stripped conductor, but is however less than the maximum section of the end-piece, and an open position in which the minimum section of the passage defined by the jaws is at least equal to the maximum section of the cavity of the reception means, and the supply device and the reception means respectively include first and second stop devices cooperating with at least one cam surface provided on the closure device for causing the jaws to pass from the open position to the closed position when the transfer device accedes to the supply device and to the reception means, respectively.

2. The device as claimed in claim 1, wherein said through passage defined by the two jaws of the closure device has a widened shape on the side opposite the end piece reception means.

3. The device as claimed in claim 2, wherein said shape is conical.

4. The device as claimed in claim 1, wherein said end-piece reception means is removably mounted on the transfer device for use of a range of reception means appropriate to different types of end-pieces.

5. The device as claimed in claim 1, wherein said reception means have an axis and said jaws include, for their actuation, two respective bores directed parallel to the axis of the reception means, these two bores each having an oblique cam surface cooperating with stop devices associated with said supply device and said reception means.

6. The device as claimed in claim 5, wherein said stop devices consist of rods having oblique end surfaces, these rods being positioned for acting on said cam surfaces and penetrating into said bores when said transfer device accedes to the supply device or to the reception means.

7. The device as claimed in claim 1, wherein said holding device includes, for centering and holding the conductor in position, two jaw bits movable in opposite directions with respect to each other along the same axis of translation, under the effect of an actuation device, these two jaw bits having two cooperating jaws of complementary shape each having, on each side of a first plane parallel to said axis of translation, two respective faces oblique with respect to each other and which extend in two secant planes perpendicular to said first plane, said two planes having an intersection straight line which divides each of said faces into two parts.

8. The device as claimed in claim 7, wherein said two parts of each of said faces are offset with respect to each other.

9. The device as claimed in claim 7, wherein said two secant planes are perpendicular to each other.

* * * * *